US006768882B2

(12) United States Patent
Omoto et al.

(10) Patent No.: US 6,768,882 B2
(45) Date of Patent: Jul. 27, 2004

(54) FIXING TEMPERATURE CONTROL METHOD UTILIZING NEW FACTORS AND IMAGE FORMING APPARATUS

(75) Inventors: Tetsuko Omoto, Hino (JP); Junichi Hamada, Hachioji (JP); Kiyoaki Kawamoto, Kunitati (JP); Haruo Iwahashi, Akishima (JP); Kazuhiko Uneme, Sagamiko-machi (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/216,042

(22) Filed: Aug. 8, 2002

(65) Prior Publication Data

US 2003/0039480 A1 Feb. 27, 2003

(30) Foreign Application Priority Data

Aug. 21, 2001 (JP) ..... 2001-250242
Sep. 25, 2001 (JP) ..... 2001-291105

(51) Int. Cl.[7] ..... G03G 15/20
(52) U.S. Cl. ..... 399/69; 399/43; 399/44
(58) Field of Search ..... 399/69, 44, 43, 399/70, 323; 219/216

(56) References Cited

U.S. PATENT DOCUMENTS 5,319,428 A * 6/1994 Maruko et al. ..... 399/69
5,555,075 A * 9/1996 Fukano et al. ..... 399/69
5,761,575 A * 6/1998 Kimoto ..... 399/70

FOREIGN PATENT DOCUMENTS

JP 55-77771 * 6/1980
JP 7-271238 * 10/1995

* cited by examiner

*Primary Examiner*—Quana Grainger
(74) *Attorney, Agent, or Firm*—Squire, Sanders & Dempsey L.L.P.

(57) ABSTRACT

A method of controlling a fixing temperature of a fixing device having a heat roller provided with a heat source and a first temperature detector provided at the vicinity of the heat roller, and having a pressure roller, which is in pressure contact with the heat roller, provided with a second temperature sensor at the vicinity of the pressure roller, having the steps of; detecting a temperature of the pressure roller by the second temperature detector; and varying a control temperature of the heat roller according to a detected temperature of the pressure roller.

11 Claims, 12 Drawing Sheets

FIXING TEMPERATURE CONTROL METHOD UTILIZING NEW FACTORS AND IMAGE FORMING APPARATUS

BACKGROUND OF THE INVENTION

The present invention relates to an image forming apparatus of a copying machine, printer or the like, and particularly to a fixing temperature control method of the fixing device of the image forming apparatus.

In an image forming apparatus based on an electrophotographic process, a fixing device comprising a heat roller and a pressure roller for bringing toner image-carrying recording paper in mechanical contact with this heating roller is generally provided with temperature detecting means for detecting temperature of heating roller surface. The controller of the image forming apparatus (hereinafter referred to as "controller") having received the detected temperature information exercises on/off control of such a heating source as a halogen lamp built in the heating roller in such a way that temperature of the heating roller surface is kept constant, thereby maintaining stable fixing performance.

The time required for heating operation (hereinafter referred to as "warm-up") where the heating source of a fixing device heats the heating roller up to the temperature that allows copying is set in such a way that the heating roller temperature reaches the level that allows copying immediately after the lapse of warm-up time, even under the severe conditions in terms of fixing performance if the environmental conditions are within the range guaranteed in the specification. This temperature that allows copying remains constant despite subsequent change in the conditions of using the image forming apparatus.

The temperature allowing copying equipped with this constant value is sufficient to ensure stable fixing performance, but involves problems in terms of saving energy.

Generally, in an image forming apparatus, the temperatures at various portions of the apparatus will be reduced if power is turned off for a long time. Once the copiable temperature has been reached by turning on power supply, the temperature inside the equipment including the pressure roller is gradually increased with the lapse of time by the heat source of the fixing device as long as power is kept turned on.

During the copying operation, the heat source is kept turned on to heat the heat roll. Almost all the heat is transferred to the recording paper carrying a toner image, and therefore the temperature of the pressure roller does not rise abruptly.

In the idling mode, the heat source keeps the heat roller at the copiable temperature using the power weaker than that in the copy mode, but the heat during this time does not cause an abrupt rise of pressure roller temperature.

The temperature of the heat roller surface is detected by a heat roller temperature sensor, and this surface temperature is kept at an appropriate temperature. However, it is difficult for the aforementioned temperature sensor to read changes in pressure roller temperature.

Rise of pressure roller temperature reduces the heat transferred to the pressure roller from the heat roll in the fixing mode. It can be said that, in order to ensure a certain level of fixing performance, the temperature on the heat roll surface immediately before fixing operation is saved more when a certain period of has passed after power was turned on, than immediately after power has been kept turned on for a long time.

However, keeping the control temperature on the heat roller constant despite the time when power is supplied to the image forming apparatus signifies that heating is excessive. This means that energy is wasted.

The first object of the present invention is to provide an energy-saving fixing temperature control method that detects or predicts the temperature of a pressure roller and minimizes the power consumption.

The Japanese Application Patent Laid-Open Publication No. Hei 02-154284 discloses a film fixing device comprising a fixing film to be transported, a heating body equipped with a heat generating resistor for melting toner on the sheet through a fixing film, and a pressure roller for gripping the sheet in mechanical contact with the heating body through the fixing film.

In order to ensure that toner is softened, melted and fixed with sheet firmly, and so-called high-temperature offset does not occur, the fixing device is preferred to exercise control so as to keep the temperature of the fixing roller and heating body to a level appropriate to fixing operation.

To achieve this purpose, the heat roller fixing device uses temperature detecting means comprising a thermister or the like to detect the temperature on the fixing roller surface. Based on the detected temperature, it exercises on/off control of the power supplied to the heat source.

The film fixing device disclosed in the aforementioned Official Publication uses a heat generating resistor of low heat capacity to accelerate the temperature rise. This is accompanied by the problem of the temperature of the heat generating resistor itself tending to be changed much by a slight change of electric power.

To solve this problem, the heating body of a film fixing device is designed in the following configuration: A heat generating resistor is installed on one side of the highly heat conductive substrate, and temperature detecting means is arranged on the other side. This temperature detecting means is brought in contact with the backside of the fixing film via the protective coating layer such as a glass or a ceramic layer. Big changes in temperature of the heat generating resistor are made gentle by installation of the temperature detecting means through such a good heat conductive substrate, and the temperature at the position in sliding contact with the fixing film is detected. Based on the detected temperature, the power to the heat generating resistor is placed under ON/OFF control.

Japanese Application Patent Laid-Open Publication No. Hei 10-69187 discloses a fixing device characterized by comprising magnetic flux generating means for inducing electricity and heating housed in the heat roll, and temperature detected means equipped with a temperature measuring element engaged with the portion where the induced current generated on the heat roller is the densest.

Using the aforementioned techniques, however, saving of power consumption has been insufficient especially from the viewpoint of energy saving.

From the viewpoint of energy saving in recent years, there has been a growing demand for a fixing device characterized by a very short warm-up time for allowing electric power to be kept turned off when not used. Not only that, from the viewpoint of saving natural resources and energy, it has become necessary to minimize the power consumption during the wait state (the state when the device is not used after an image forming apparatus power switch is turned on (called "warm-up)), and to reduce the time of heating the fixing device in the wait state in such a way that electric power is supplied to the fixing device only when the device is used, thereby enabling the device ready for operation in the shortest possible time.

The second object of the present invention is to provide an image forming apparatus characterized by excellent energy saving capability in the warm-up state and wait state (when the image forming apparatus is not used) and by reduced operation costs.

The first object of the present invention can be achieved by the following structures:

(1) A method of controlling a fixing temperature of a fixing device having a heat roller provided with a heat source and a first temperature detector provided at the vicinity of the heat roller, and having a pressure roller, which is in pressure contact with the heat roller, provided with a second temperature sensor at the vicinity of the pressure roller, comprising the steps of; detecting a temperature of the pressure roller by the second temperature detector; and varying a control temperature of the heat roller according to a detected temperature of the pressure roller.

(2) A method of controlling a fixing temperature of a fixing device having a heat roller provided with a heat source, and having a pressure roller, which is in pressure contact with the heat roller, comprising the steps of; measuring a elapsed time from a time of heating operation completion when the temperature of the heat roller reached at a temperature where fixing is capable; varying a control temperature of the heat roller according to the elapsed time.

(3) A method of controlling a fixing temperature of a fixing device having a heat roller provided with a heat source and a first temperature detector provided at the vicinity of the heat roller, and having a pressure roller, which is in pressure contact with the heat roller, provided with a second temperature sensor at the vicinity of the pressure roller, comprising the steps of; detecting a temperature of the pressure roller by the second temperature detector; measuring a elapsed time from a time of heating operation completion when the temperature of the heat roller reached at a temperature where fixing is capable; and varying a control temperature of the heat roller according to the detected temperature of the pressure roller the elapsed time from a time of heating operation completion.

(4) The method of controlling the fixing temperature according to the structures (1) through (3), further comprising the steps of; detecting a temperature and/or a humidity in an image forming apparatus including the fixing apparatus; and varying the control temperature of the heat roller according to the detected temperature and/or humidity in the image forming apparatus.

The second object of the present invention can be achieved by the following structures (5) through (9):

(5) An image forming apparatus comprising; a toner image forming section for forming a toner image on a photoreceptor; a transfer section for transferring the toner image from the photoreceptor on to a transfer sheet; and a fixing device for fixing the toner image on the transfer sheet, the fixing device having: a heat roller provided with a heat source and a first temperature detector at the vicinity of the heat roller; and a pressure roller, which is in pressure contact with the heat roller, provided a second temperature detector at the vicinity of the pressure roller; a controller for controlling the fixing temperature of the fixing device; wherein, a low power mode is established in a wait state of the image forming apparatus, and the controller varies a temperature setting for the heat roller in the low power mode according to the temperature of the pressure roller.

(6) An image forming apparatus comprising: a toner image forming section for forming a toner image on a photoreceptor; a transfer section for transferring the toner image from the photoreceptor on to a transfer sheet; and a fixing device for fixing the toner image on the transfer sheet, the fixing device having: a heat roller provided with a heat source and a first temperature detector at the vicinity of the heat roller; a pressure roller, which is in pressure contact with the heat roller; a controller for controlling the fixing temperature of the fixing device; and a temperature estimation device for estimating a temperature of the pressure roller based on an operation history of the fixing device; wherein, the controller controls the fixing temperature according to the estimated temperature of the pressure roller.

(7) An image forming apparatus comprising: a toner image forming section for forming a toner image on a photoreceptor; a transfer section for transferring the toner image from the photoreceptor on to a transfer sheet; and a fixing device for fixing the toner image on the transfer sheet, the fixing device having: a heat roller provided with a heat source and a first temperature detector at the vicinity of the heat roller; and a pressure roller, which is in pressure contact with the heat roller; a power supply device for supplying power to the fixing device; a time measuring device for measuring a time period of supplying power to the fixing device; a temperature estimation device for estimating a temperature rise rate of the heat roller, when the power supply device have supplied a power to the fixing device during a warm-up mode, based on the heat roller temperature and the time period of supplying power; and a controller for controlling the fixing temperature of the fixing device; wherein, the controller controls the fixing temperature according to the estimated temperature rise rate of the heat roller.

(8) The image forming apparatus according to (7), wherein a low power mode is established in a wait state of the image forming apparatus, and according to a temperature rise rate calculated by the temperature estimation device, the controller adjusts a setting temperature of the heat roller in the low power mode.

(9) An image forming apparatus comprising: a toner image forming section for forming a toner image on a photoreceptor; a transfer section for transferring the toner image from the photoreceptor on to a transfer sheet; and a fixing device for fixing the toner image on the transfer sheet, the fixing device having: a heat roller provided with a heat source and a first temperature detector at the vicinity of the heat roller; and a pressure roller, which is in pressure contact with the heat roller; a controller for controlling the fixing temperature of the fixing device; wherein, when a setting temperature of the heat roller in a fixing mode is changed from A to B, a setting temperature of the heat roller in a low power mode is adjusted to C, which is previously set corresponding to the setting temperature B in the fixing mode.

DETAILED DESCRIPTION OF THE PREFERRED EMBODIMENT

Figure 1:
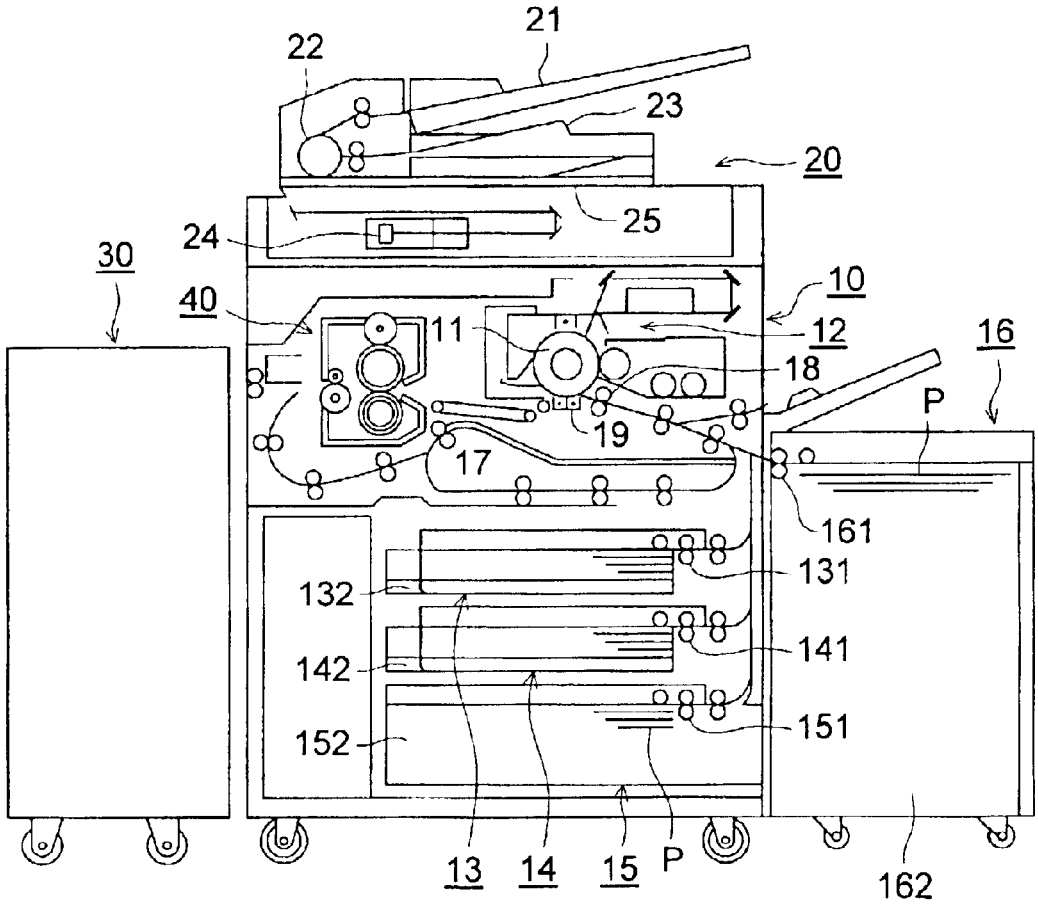
FIG. 1 is a schematic drawing representing the configuration of one embodiment of the image forming apparatus of the present invention.

The following describes the embodiments of the present invention with reference to drawings:

FIG. 1 is a schematic drawing representing the configuration of one embodiment of the image forming apparatus that allows effective use of the control method of the present invention.

In this figure, numeral 10 denotes an image forming apparatus for forming an image on a recording paper by an electrophotographic method, 20 a document reader for reading the image of the document and outputting the image data, 30 a post-processor for post-processing such as sorting, stapling and punching.

The image forming apparatus 10 has a photoconductor 11, image forming means 12 for forming a toner image on the photoconductor 11 by means of known charging, exposing and developing means, etc. transfer means 19 for transferring the toner image of the photoconductor 11 onto recording paper, paper feeders 13, 14, 15 and 16 for storing recording paper P where the image is formed, a recording paper reversing feeder 17 for forming duplex images and a fixing device 40 for fixing a toner image formed on recording paper P. Numeral 18 is a resist roller.

The toner image formed on the photoconductor 11 by charging, exposure and development is transferred onto the recording paper P by transfer means 19, and is fixed in place by the fixing device 40.

The aforementioned fixing device 40 comprises a heat roller and pressure roller that rotates in mechanical contact with the heat roll. Further, the surface temperature of the aforementioned heat roller is detected by temperature detecting means. Based on the detected information, supply of electric power to the heat source built in the heat roller is placed under on/off control through a controller (not illustrated), and power is kept within a predetermined range. The details will be described later with reference to FIG. 2.

The paper feeder 13 is operated by a paper feed start signal, and contains paper feed means 131 for separate record paper P stored in a cassette 132 into each and feeding each separated sheet. Similarly, paper feeders 14 and 15 each comprise paper feed mean 141 and a cassette 152, and a paper feed means 151 and a cassette 152. A paper feeder 16 has a large-capacity cassette 162 and paper feed means 161.

The document reader 20 comprises a document feed base 21, a platen roller 22 for feeding a document and forming a read-out position, a document ejector base 23 where the read-out document is mounted, an image sensor 24 for receiving image light and converting it into an image signal, and a platen glass 25 where the document is placed. It reads out the document in the mode where the document on the document feed base 21 is read while it is fed by a platen roller 22, or in the mode where a document having been placed on the platen glass 25 is read.

Figure 2:
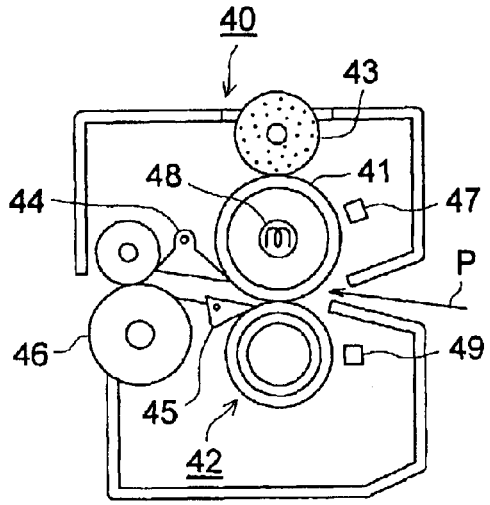
FIG. 2 is a schematic drawing for explaining the configuration of the image forming apparatus of the present invention.

FIG. 2 is a schematic drawing for explaining the configuration of an image forming apparatus. In the figure, the fixing device 40 comprises;

- a heat roller 41 incorporating a heat source (hereinafter referred to as "fixing heater") 48 consisting of a halogen lamp, etc.,
- a pressure roller 42 for bringing recording paper P in mechanical contact with the heat roller 41,
- a cleaning roller 43 for cleaning the surface of the heat roller 41,
- separating pawls 44 and 45 for separating from a heat roller 41 and pressure roller 42 the recording paper P having passed through the fixing unit,
- a feed roller 46 for feeding the fixed recording paper P,
- a heat roller temperature sensor as the first temperature detecting means for detecting the temperature of the heat roller 41 and controlling the temperature (hereinafter referred to as "heat roller temperature sensor") 47, and a pressure roller temperature sensor for detecting the temperature of the pressure roller 42 as a second temperature detecting means (hereinafter referred to as "pressure roller temperature sensor") 49.

When the power supply of the image forming apparatus is turned on, the fixing heater 48 is turned on, and the aforementioned warm-up operation starts. After completion of warm-up operation, the controller actuates the motor (not illustrated) for driving the heat roller 41 in response to the copy command when the copy button or the like is turned on. Then the heat roller 41 is rotated and the pressure roller 42 driven by the heat roller 41 is also rotated. As shown by an arrow mark, the recording paper P carrying the unfixed toner image enters the fixing device 40 and is heated and fixed in the process of passing through the nip formed by the heat roller 41 and pressure roller 42. The aforementioned heat roller 41 is manufactured by forming a releasing layer of fluorine resin or the like on the surface of a cylindrical metallic substrate.

The pressure roller 42 is composed of a cored bar, a silicone rubber sponge, namely a heat-proof low-hardness elastic layer of foamed silicone rubber, and a releasing layer (a smooth surface layer made of fluorine resin, silicone rubber, etc.).

Figure 3:
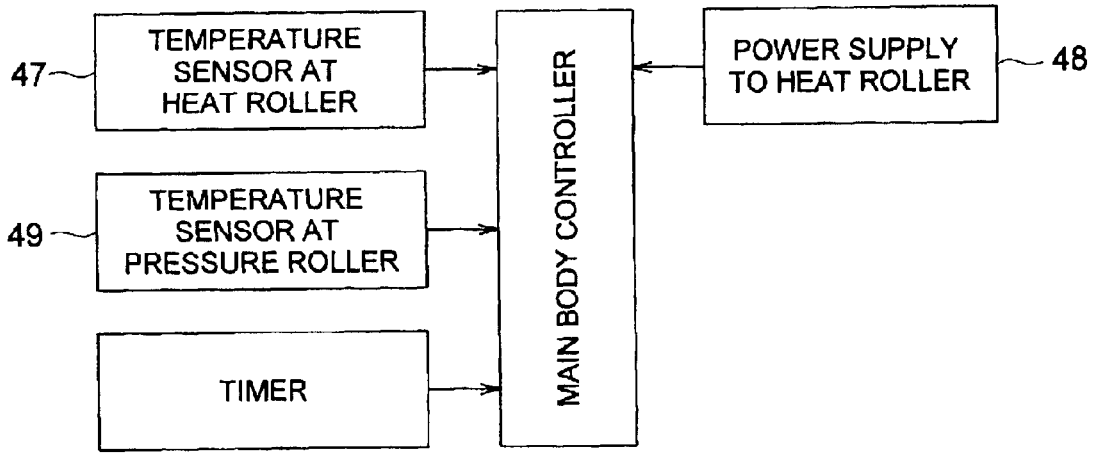
FIG. 3 is a block diagram for explaining the fixing temperature control method of the present invention.
Figure 4:
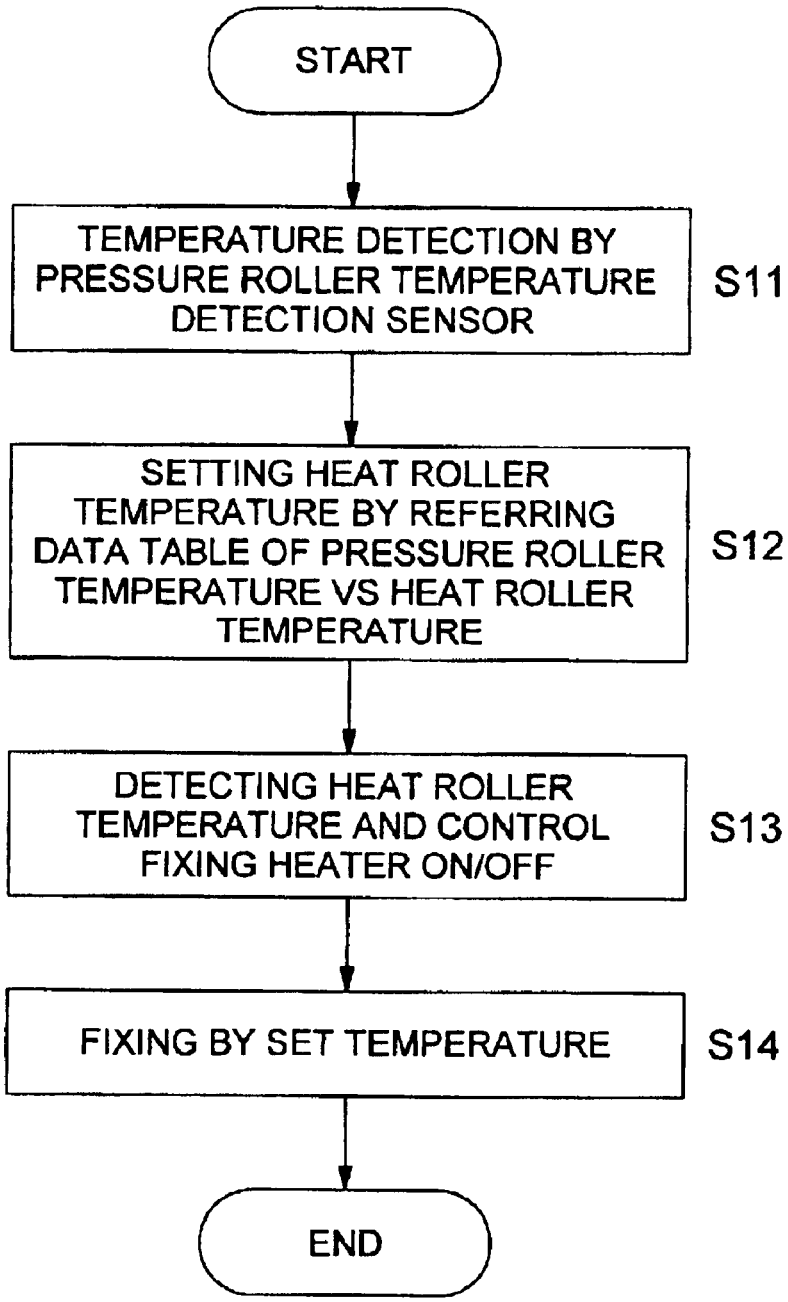
FIG. 4 is a flow chart for explaining a first embodiment of the fixing temperature control method of the present invention.
Figure 5:
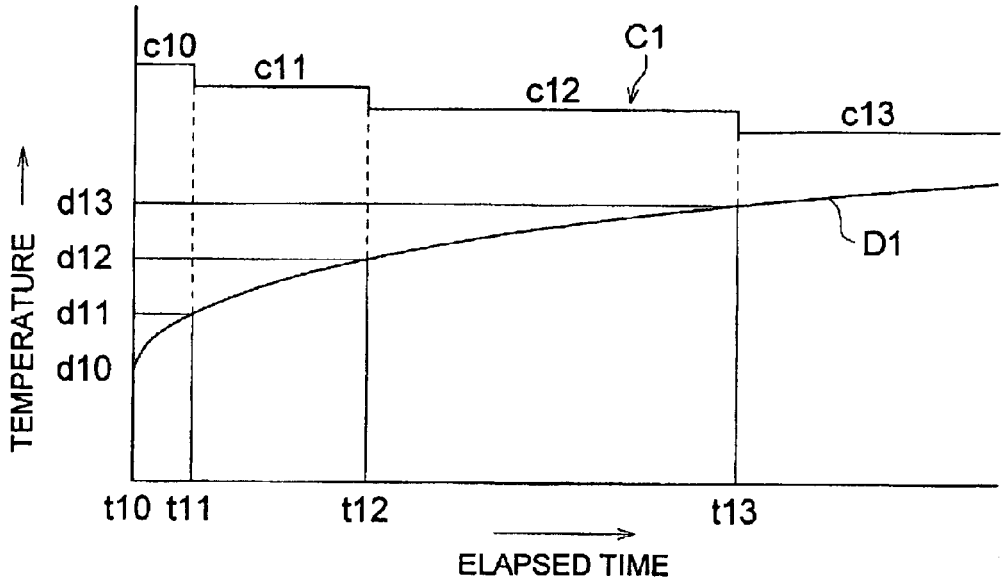
FIG. 5 is a graph for explaining a first embodiment of the fixing temperature control method of the present invention.
Figure 6:
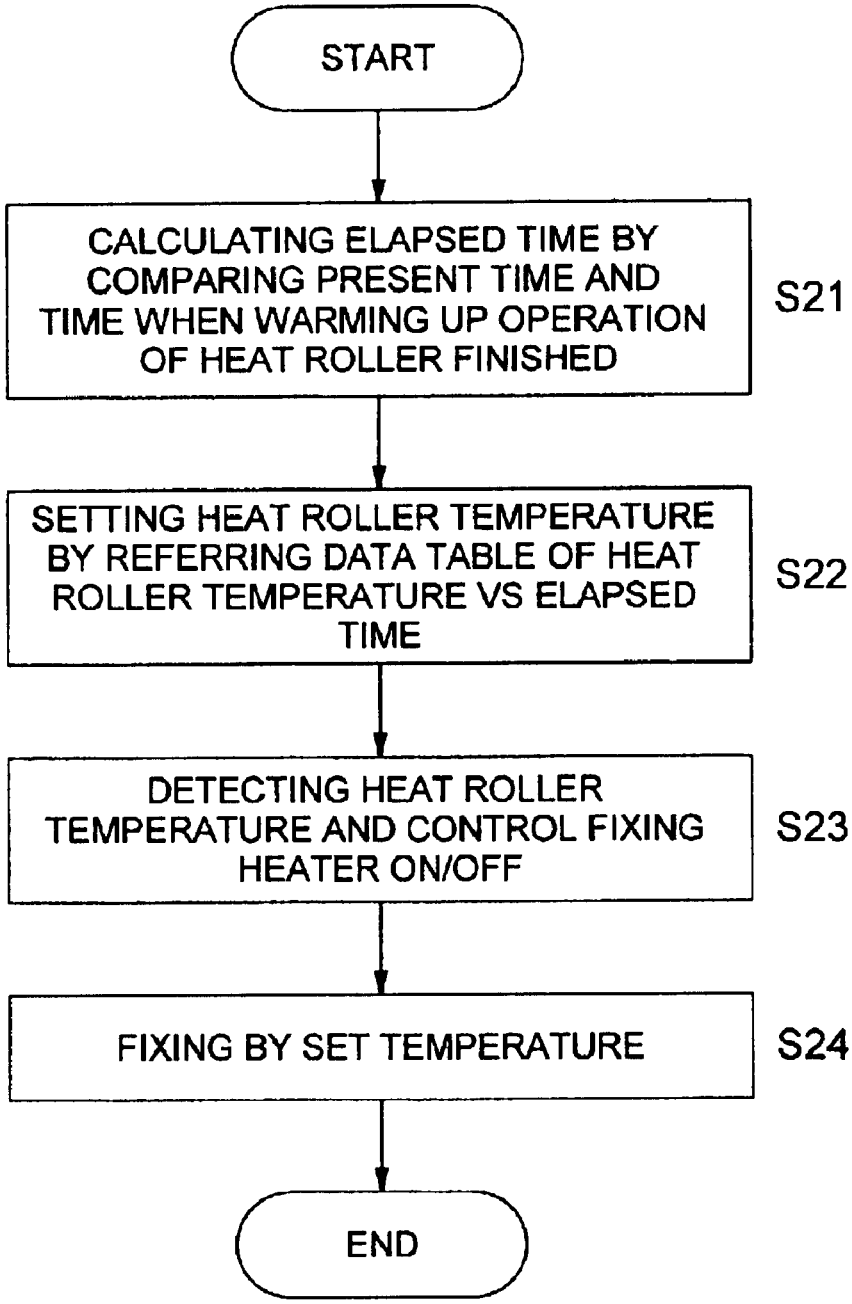
FIG. 6 is a flow chart for explaining a second embodiment of the fixing temperature control method of the present invention.
Figure 7:
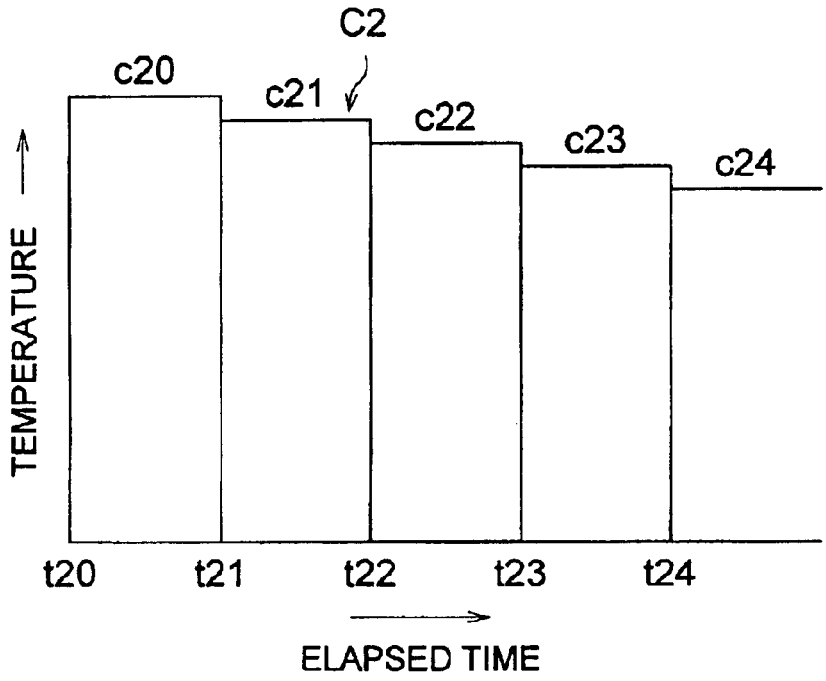
FIG. 7 is a graph for explaining a second embodiment of the fixing temperature control method of the present invention.
Figure 8:
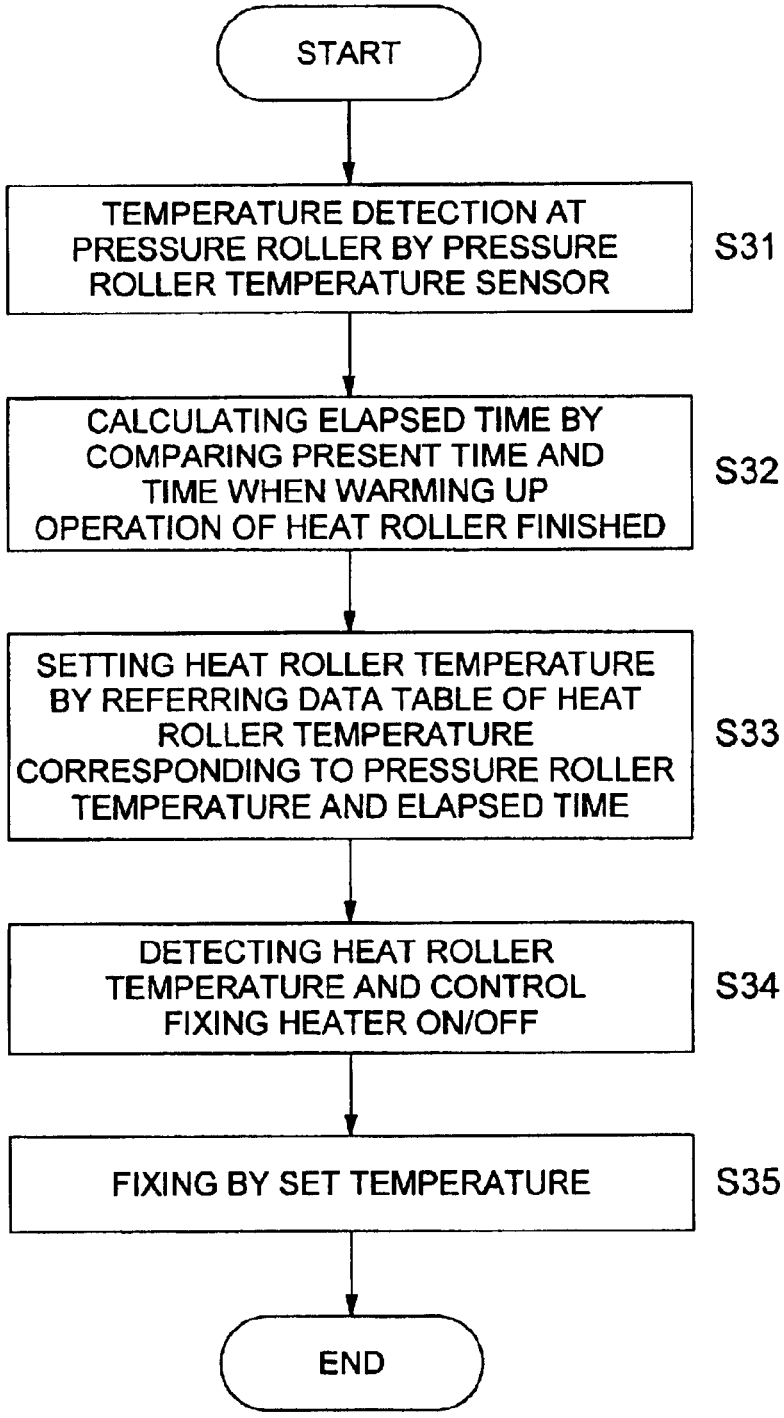
FIG. 8 is a flow chart for explaining a third embodiment of the fixing temperature control method of the present invention.
Figure 9:
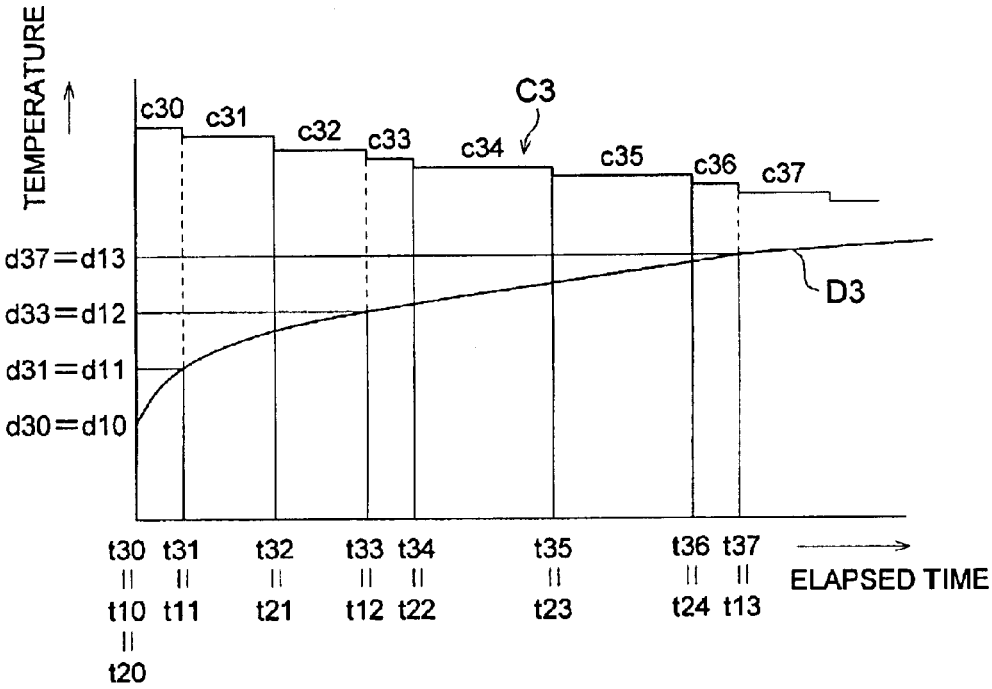
FIG. 9 is a graph for explaining a third embodiment of the fixing temperature control method of the present invention.

FIG. 3 is a block diagram for explaining the fixing temperature control method of the present invention. FIGS. 4, 6 and 8 are flow charts for explaining a first, second and third embodiments of the fixing temperature control method of the present invention. FIGS. 5, 7 and 9 are graphs for explaining a first, second and third embodiments of the fixing temperature control method of the present invention.

The first embodiment of the fixing temperature control method of the present invention will be described with reference to FIGS. 4 and 5.

In response to the aforementioned copy command, the temperature on the surface of the pressure roller 42 is detected by the pressure roller temperature detection sensor 49 (S11). By making reference to the data table on the temperature of the heat roller 41 with respect to the detected temperature of the pressure roller 42, the aforementioned controller sets the heat roller temperature (S12). The temperature of the heat roller 41 is measured by the heat roller temperature sensor 47. The controller exercises fixing heater on/off control (S13), and recording paper P is fixed in position at the set temperature of the heat roller 41 (S14).

In order to provide automatic control of the controlled temperature of the heat roller 41 in response to the detected temperature of the pressure roller 42, the data table on the control temperature of the heat roller 41 with respect to the detection temperature of the pressure roller 42 is stored by program into the controller memory in advance, and the controller compares between the data table in question and the aforementioned detection temperature to calculate the set temperature of the heat roller 41.

The on/off pattern of the fixing heater 48 is determined by the calculated set temperature in question, and supply of electric power to the fixing heater 48 is placed under on/off control by the command from the controller.

FIG. 5 is a graph representing the shift of heat roller control temperature with respect to the pressure roller detecting temperature corresponding to the flow chart in FIG. 4. The vertical axis represents temperature and the horizontal axis indicates the lapse of time. C1 denotes the control temperature of the heat roller 41 corresponding to the detection temperature of the pressure roller 42, and D1 indicates the detecting temperature of the pressure roller 42. "d10" shows the temperature of the pressure roller 42 immediately after the aforementioned copy command is issued upon completion of the aforementioned warm-up operation, and d11, d12 and d13 show the values obtained by dividing the rising pressure roller temperature by a certain temperature range. When the times elapsed before these values are reached after completion of warm-up operation are represented as t1, t2, and t3, the control temperature of the pressure roller can be decreased stepwise in the order of c10, c11, c12 and c13 for each time elapsed by the value calculated by the controller.

The following describes the second embodiment of the fixing temperature control method of the present invention with reference to FIGS. 6 and 7.

In response to the aforementioned copy command, the controller compares between the current time detected by the timer (not illustrated) or the like built in the image forming apparatus and the time at the completion of preheating of the heat roller 41, thereby calculating the elapsed time. Referring to the data table of the heat roller temperature with respect to the elapsed time, the controller sets the temperature of the heat roller (S22). The temperature of the heat roller 41 is detected by the heat roller temperature sensor, and the fixing heater 48 is placed under on/off control by the controller (S23). The recording paper P is fixed at the set temperature of the heat roller 41 (S24).

In order to allow automatic change of the control temperature of the heat roller 41 in conformity to the time elapsed during power supply when idling or copying operation is performed subsequent to turning on of the power, the data table on control temperature of the heat roller 41 with respect to the elapsed time is input by a program into the controller in advance, similarly to the case of the first embodiment. This enables the controller to estimate the control temperature of the corresponding heat roller 41 from the aforementioned elapsed time calculated.

When the temperature of the pressure roller 42 is increased with the lapse of time during power supply, there is a decrease in the heat value deprived from the heat roller 41 by the pressure roller 42 at the time of fixing. This makes it possible to reduce the control temperature of the heat roller 41 below the level at the point of time immediately after completion of preheating.

In other words, it can be said that the data table of the control temperature of the heat roller 41 with respect to the aforementioned elapsed time is created by predicting the rising temperature of the pressure roller 42.

FIG. 7 is a graph representing the shift of the heat roller temperature control temperature corresponding to the elapsed time, corresponding to the flow chart of FIG. 6. C2 denotes the control temperature of the heat roller 41 corresponding to the elapsed time. "t20" shows the time point when the preheating of the heat roller 41 has completed. When t20, t21, t22, t23 and c24 are used to represent the time elapsed after preheating is completed, the heat roller control temperature corresponding to the elapsed time can be decreased stepwise in the order of C20, c21, c22, c23 and c24 for each lapsed time mentioned above according to the value calculated by the aforementioned controller.

The following describes the third embodiment according to the fixed temperature control method of the present invention with reference to FIGS. 8 and 9.

In response to the aforementioned copy command, the temperature on the surface of the pressure roller 42 is detected by the pressure roller temperature sensor 49 (S31). The controller calculates the lapsed time by comparing between the current time of day detected by the aforementioned timer and the time of day at the completion of warm-up operation (S32). Referring to the data table of the heat roller temperature with respect to the pressure roller temperature and the elapsed time, the controller sets the temperature of the heat roller (S33). The temperature of the heat roller 41 is detected by the heat roller temperature sensor 47, and the fixing heater is placed under on/off control by the controller (S34). The recording paper P is fixed at the set temperature of the heat roller 41 (S35).

Similarly to the cases in the first and second embodiments, the data table on control temperature of the heat roller 41 with respect to the detection temperature of the pressure roller 42 and the elapsed time is input by a program into the controller in advance. This enables the controller to estimate the control temperature of the corresponding heat roller 41 from the input detection temperature of the pressure roller 42 and the aforementioned elapsed time calculated.

FIG. 9 is a graph representing the shift of the detection temperature of the pressure roller and heat roller control temperature with respect to the elapsed time, corresponding to the flow chart of FIG. 8. C3 denotes the control temperature of the heat roller 41 corresponding to the aforementioned elapsed time and the detection temperature of the pressure roller 42. D3 shows the detection temperature of the pressure roller 42, and d30 shows the temperature of the pressure roller 42 immediately after aforementioned copy command is issued upon completion of preheating of the heat roller 41.

In the figure, the control temperature of the heat roller 41 in response to the aforementioned elapsed time is reduced at timed intervals corresponding to the elapsed times of t32, t33, t34, t35 and t36 indicated by vertical solid lines in the downward direction starting from C3 of the aforementioned graph. They correspond to t21, t22, t23 and t24 in FIG. 7.

The control temperature of the heat roller 41 is reduced in response to the detection temperature of the pressure roller 42 at timed intervals corresponding to the elapsed times of t31, t33 and t37 indicated by vertical broken lines in the downward direction starting from C3 of the aforementioned graph (until the lines cross the aforementioned D3). They correspond to t11, t12 and t13 in FIG. 5.

More subtle lowering line can be obtained by lowering the control temperature of the heat roller 41, using two data items of detection temperature of the pressure roller 42 and elapsed time.

The denotations of d30, d31, d33 and d37 are values obtained by dividing the rising pressure roller temperature by a certain temperature range, and correspond to d10, d11, d12 and d13, respectively.

The following describes the fourth embodiment of the fixed temperature control method of the present invention:

The temperature and humidity in the image forming apparatus comprising a fixing device 40 are detected by a thermometer or hygrometer installed inside the image forming apparatus, and these temperature and humidity are stored in the aforementioned data table used in the first to third embodiments in advance, whereby permitting calculation of the control temperature of the heat roller 41 where the temperature or humidity are adopted.

Figure 12:
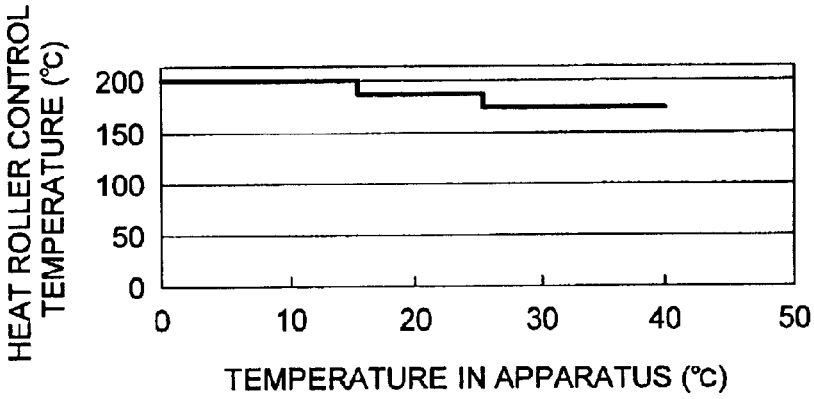
FIGS. 12(*a*) and (*b*) are graphs representing examples of the fixing temperature control method of the present invention.
Figure 12:
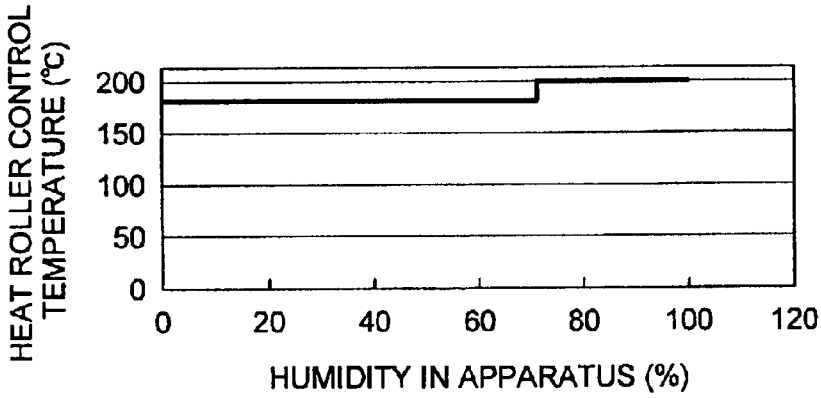

FIG. 12(*a*) is a graph representing an example of setting the heat roller control temperature in conformity to the temperature inside the image forming apparatus. When the temperature inside the apparatus is high, the temperature of transfer paper or the like also gets to be high, and the control temperature of the heat roller required for fixing can be set to a low level.

FIG. 12(*b*) is a graph representing an example of setting the heat roller control temperature in conformity to the humidity inside the image forming apparatus. When the humidity inside the apparatus is high, moisture is absorbed by transfer paper with the result that heat value required for fixing is increased. This requires the fixing temperature to be set at a high value.

As described above, the temperature and humidity inside the image forming apparatus are detected and the pressure roller temperature is set in conformity to these values, whereby the required and necessary fixing performance can be obtained, without excessive energy being consumed.

The following describes the second embodiment of the fixed temperature control method of the present invention:

In this embodiment, the heat roller 41 has an outer diameter of 40 mm. It is made of a 3.5 mm thick metallic pipe, and the surface is coated with 21 $\mu$m thick fluorine resin releasing layer.

The pressure roller 42 has an elastic layer formed of 5 mm thick silicone rubber having a hardness of JIS-A30 deg. coated on the outer surface of a cored bar. The outer surface of this layer is further covered with a 50 $\mu$m thick releasing layer of fluorine tube.

Two fixing heaters 48 are arranged inside the heat roller 41, and electric power of 1310 W is used for these two heaters.

Various feed units are configured to ensure that the copy speed, namely, the fixing speed of the image forming apparatus is 45 copies per minute (for long edge feeding of the A4-sized recording paper).

The control temperature immediately after completion of preheating of the heat roller 41 is set at 195° C. in such a way that the aforementioned control temperature is dropped down to a minimum of 170° C. in conformity to the elapsed time.

With reference to the configuration of the aforementioned embodiment, Table 1 shows the energy consumption efficiencies as compared the conventional fixing temperature control method wherein the control temperature of the heat roller 41 is constant at 195° C., and the fixing temperature control method of the present invention wherein the control temperature of the heat roller 41 is reduced from 195° C. in conformity to the lapsed time.

TABLE 1

| | Conventional | Present invention |
|---|---|---|
| A | 224.6 | 205.4 |
| B | 194.6 | 171.2 |
| E | 198.0 | 175.5 |
| Difference | 22.5 | |

In this Table, A denotes the volume of power consumption during one hour after power is turned on, and B indicates the power consumption during one hour after measurement of A.

E denotes an energy consumption efficiency as quoted in the "Manufacturer's criteria for improvement of copier performance" in Notification NO. 193 issued by the Japanese Ministry of Economy, Trade and Industry on Mar. 31, 1999. It can be expressed as follows:

$$E=(A+7\times B)/8$$

Where A and B are represented in W and E in Wh/h.

As shown in Table 1, energy consumption efficiency is improved by 22.5 in the embodiment of the fixed temperature control method of the present invention as compared with that in the conventional fixed temperature control method.

According to the first embodiment of the fixed temperature control method of the present invention, the pressure roller temperature is detected and the heat roller control temperature is changed, whereby temperature can be controlled in conformity to the heat value removed from the heat roller by the pressure roller. Thus, the heat roller control temperature can be reduced with the rise of pressure roller temperature, with the result that energy saving can be achieved.

Further, according to the second embodiment, there is no need of using a pressure roller temperature sensor, resulting in cost cutdown.

Further, according to the third embodiment, the heat roller temperature is controlled by a combination of pressure roller temperature detection and elapsed time during power supply, thereby ensuring subtle temperature control to be made and efficient energy saving to be achieved.

Further, according to the fourth embodiment, the data on temperature and humidity in the image forming apparatus is adopted to allow heat roller temperature in each energy type to be controlled in conformity to changes in ambient temperature and humidity.

Figure 10:
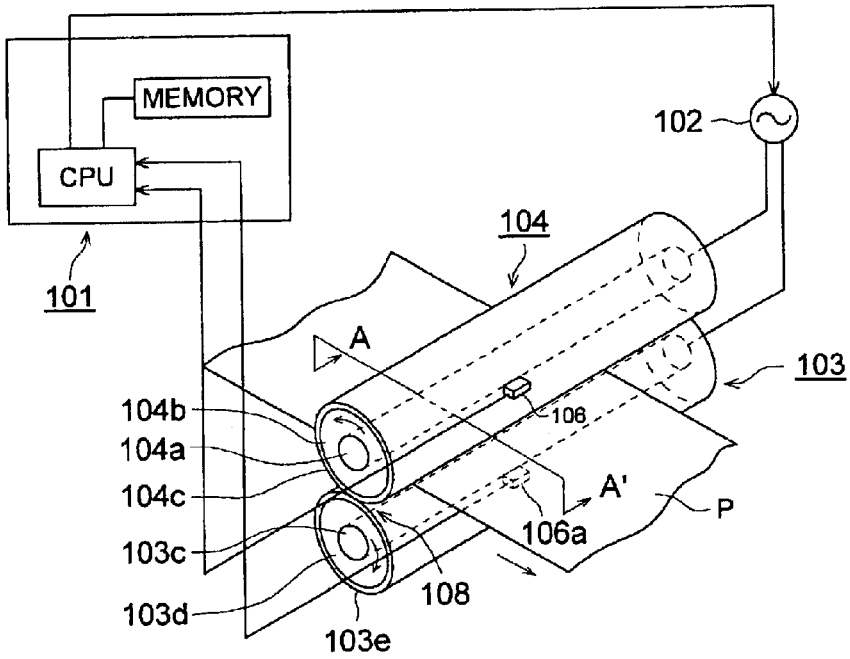
FIGS. 10(*a*) through (*c*) are schematic diagrams representing an example of the configuration of the fixing device of the present invention.
Figure 10:
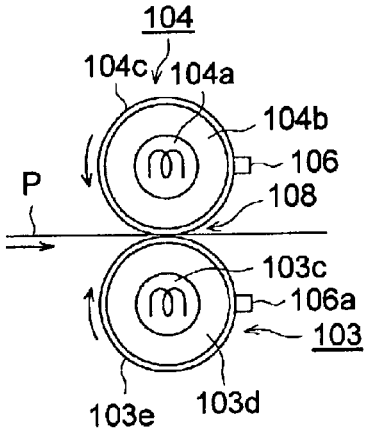
Figure 10:
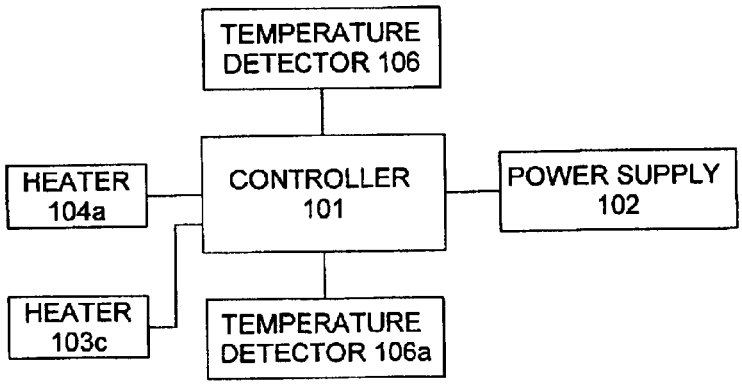

The following describes the details of the fixing device of the present invention described in Configuration (5) with reference to FIGS. 10(*a*) to (*c*).

FIGS. 10(*a*) through (*c*) are schematic diagrams representing an example of the configuration of a fixing device of the present invention. FIG. 10(*a*) is a schematic diagram representing an example of the heat fixing device comprising;

a heat roller 104 as a rigid roller further consisting of a heating body 104*a*, heat proof elastic layer 104 and releasing layer 104*c*, and a pressure roller 103 incorporating a heating body 103C. FIG. 10(*b*) is a schematic cross sectional view along A—A'. FIG. 10(*c*) shows a schematic block diagram representing the relationship among various members constituting a fixing device of FIG. 10(*a*).

As shown in FIG. 10(*a*), the fixing device heats and melts the toner held on recording paper P, and fixes it on this recording paper P. Its surface is provided with a releasing layer 104C having a releasing property to toner. This fixing device comprises;

a heating body 104 and a heat-proof elastic layer 104*b* as constituent layers, power supply means for supplying electric power to the heating body 104*a,* a pressure roller 103 rotating with the heat roller 104 by gripping the recording medium P carrying unfixed toner between the pressure roller and heating roller 104, temperature detecting means 106 and 106*a* arranged to detect the surface temperatures of heat roller 104 and pressure roller 103, and control means 101 for controlling the amount of electric power based on the temperature information coming from the aforementioned temperature detection means 106 and 106*a*.

As shown in FIGS. 10(*a*) and (*b*), the pressure roller 103 of the present invention is preferred to be a pressure rotary body whose constituent layers are;

a heating body 103C (preferably such heat generating source as a halogen lamp and nichrome wire), a heat proof elastic layer of low hardness 103*d* including a silicone rubber sponge, namely, foamed silicon rubber, and a releasing layer 103*e* having a flat surface and made of heat proof material consisting of a fluorine resin such as PFA (copolymer of tetrafluoroethylene and perfluorinated alkyl vinyl ether) or silicone rubber. Further, the pressure roller 103 is preferred to be made of a material with small heat capacity in order to increase the temperature rise speed when heating is started. Sponge has a comparatively small heat capacity and is suited for this purpose. For the same reason, the heat roller 104 is also preferred to be made of a material having a smaller heat capacity.

In other words, use of an elastic layer of low hardness such a sponge for the pressure roller 103 provides very effective means for reducing the heat capacity of the heat roller 104 and pressure roller 103. The hardness of the elastic layer is preferred to be 1 to 15° (JIS-A).

The following describes the relationship among members constituting the fixing device with reference to the block diagram of FIG. 10(*c*):

In FIG. 10(*c*), the information from the temperature detecting means 106 arranged to detect the surface temperature of the heat roller 104 and the information from the temperature detecting means 106*a* arranged to detect the surface temperature of the pressure roller 103 are fed to the CPU (central processing unit) of control means 1, and this CPU urges the power supply means 102 to supply electric power to the heating body 104*a* and/or 103*c*, based on the information on surface temperature of the heat roller 104 and/or the pressure roller 103.

The image forming apparatus of the present invention is characterized by having a low power mode and control means for changing the setting of the heat roller temperature in this low power mode in the wait state in conformity to the surface temperature of the pressure roller detected by the surface temperature detecting means.

In the wait state, the image forming apparatus is automatically shifted to the low power mode, and the CPU (central processor unit) of the aforementioned control means detects the surface temperature of the pressure roller 103 on a real-time basis. It reads from the memory the control temperature of the heat roller 104 preset in advance with respect to the surface temperature of the pressure roller 103, and controls the amount of power supplied from power supply means 102, whereby the temperature of the heat roller 104 in the low power mode is controlled.

Low power mode hereunder is defined as the mode wherein the image forming apparatus of the present invention is placed in the wait state. It is the mode where when the fixing device is not used, the temperature of the heat roller is controlled to a temperature lower than that when used (in the fix mode). Further, it is the mode where the time required to get back to the temperature for enabling fixing is adjusted to be 30 sec or less.

Figure 13:
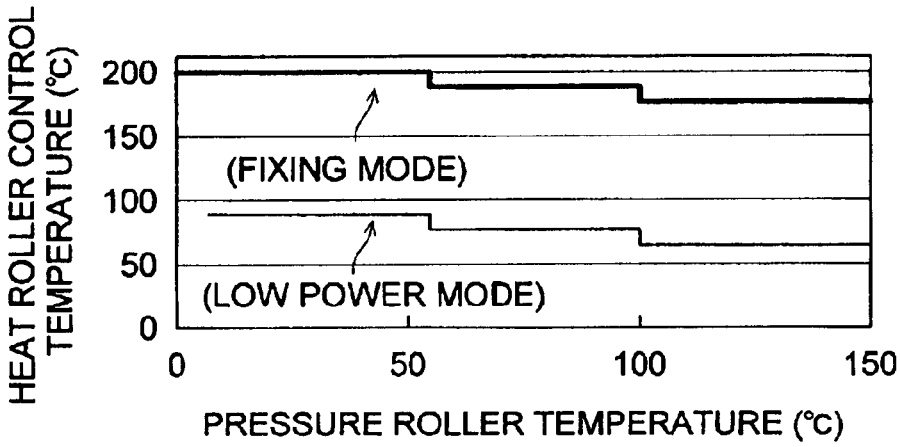
FIG. 13 is a graph representing an example of the fixing temperature control method of the present invention.

FIG. 13 is a graph representing the relationship among the pressure roller temperature, heat roller set temperature in the fixing mode in conformity to the pressure roller temperature, and heat roller set temperature in the low power mode in conformity to the heat roller set temperature.

The fixing performance is determined by the temperature of the heat roller and the pressure roller. When the heat roller temperature is high, the fixing performance requirements can be satisfied even if the heat roller control temperature is reduced. Therefore, as shown in FIG. 13, when the pressure roller temperature is high, the heat roller temperature can be reduced. Further, it is also possible to reduce heat roller temperature in the low power mode, if it is possible to ensure that recovering time from the low power mode does not exceed 30 seconds.

The image forming apparatus of the present invention in Configuration (5) is configured as follows: The CPU (central processor unit) of the control means 101 detects changes in the surface temperature of the pressure roller 103 facing to the heat roller 104 on a real-time basis, and the setting of the temperature of the heat roller 104 in the low power mode can be changed automatically in conformity to changes in the detected surface temperature of the pressure roller. It is different from the control method where the temperature of the pressure roller 102 in the aforementioned low power mode is always adjusted to a fixed temperature.

As a result, contribution of the surface temperature of the pressure roller 104 can be used for the temperature adjustment on the recording material at the time of fixing. Thus, there is no need of supplying excess power for maintaining the temperature of the heat roller 104 in the wait state, as compared to the conventional case where the heat roller setting temperature is fixed. Further, it has become possible to effectively avoid the thermal offset caused by excessive heating at the time of fixing operation.

The following describes the details of each part of the heat roller 104:

It is preferred that such a heat generating source as halogen lamp and nichrome wire is used as heating body 104*a*. Around the heating body, a heat proof elastic layer

104*b* comprising a heat proof silicone rubber or fluorine resin is arranged on the rigid substrate such as ceramic and heat roof resin. From the viewpoint of ensuring the material having an excellent mold releasing property and heat resistance to toner, fluorine resin such as polyetrafluoroethylene (PTFE), perfluoroalkoxy fluorine resin (PFA) or fluorinated ethylene propylene copolymer (FEP) is preferably used as a releasing layer 104*c*. The thickness of the releasing layer in the range from 10 to 30 $\mu$m is preferably used.

There is no restriction on temperature detecting means 106 and 106*a* arranged on the heat roller 104 and pressure roller 103 of the present invention if they are the temperature detecting means in common use. For example, a surface thermometer, thermister, thermocouple and non-contact infrared thermometer can be utilized.

Further, the temperature detecting means 106 and 106*a* are arranged on the outer surface of the heat roller 104 and pressure roller 103, respectively. It is also possible to arrange temperature detecting means in such a way that the internal surface temperature can be detected.

Figure 11:
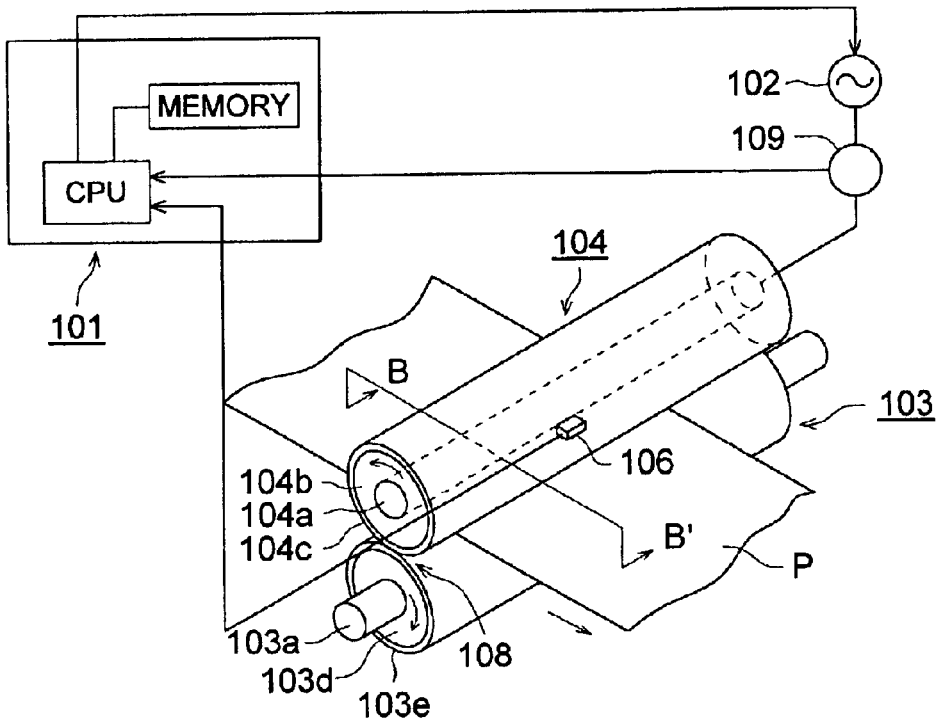
FIGS. 11(*a*) and (*b*) are schematic diagrams representing an example of other configurations of the fixing device of the present invention.
Figure 11:
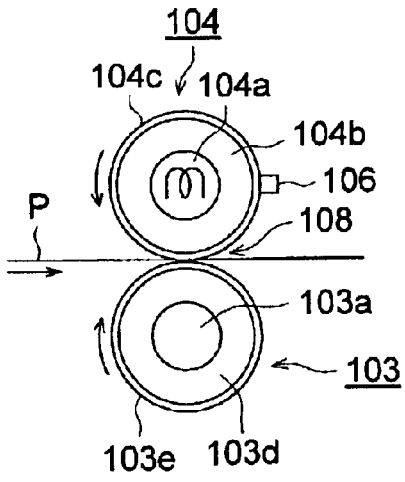

The following describes the details of the configurations (6) through (9) for the fixing device of the image forming apparatus according to the present invention with reference to FIGS. 11(*a*) and (*b*).

FIGS. 11(*a*) and (*b*) are schematic diagrams representing an example of other configurations of the fixing device of the present invention. FIG. 11(*a*) is a schematic diagram showing an example of the heat fixing device comprising:

a heat roller 104 as a rigid roller including a heat body 104*a*, heat proof elastic layer 104*b*, and releasing layer 104*c*, and a pressure roller 103 incorporating a core shaft 103*a*, a heat proof elastic layer of low hardness 103*d* and a releasing layer 103*e*.

The power supply time measuring means 9 is installed on the image forming apparatus shown in Configurations (7) and (8). FIG. 3 is an outline cross sectional view along the line B—B' in FIG. 3(*b*).

The heat roller 104 is designed in the same configuration as that of the heat roller given in FIGS. 10(*a*) and (*b*), and is made of the same material.

The pressure roller 103 comprising a core shaft 103*a*, a heat proof elastic layer of low hardness 103 formed around the aforementioned core shaft 103*a*, and a releasing layer 103*e*.

Heat proof silicone rubber and fluorine rubber having an excellent releasing property for ensuring easy separation of the recording material P from the surface are used as a releasing layer 103*e*.

Bearings are formed on both ends of the pressure roller 103, which is rotatably mounted on the frame of the fixing device and is driven thereby.

The fixing device of the image forming apparatus described in Configuration (6) is characterized in that the operation history of the fixing device (recording the operation state and wait state of the fixing device after the time of startup) is recorded and stored in the control means 101, and the CPU (central processor unit) of the control means 101 reads out the information on the aforementioned operation history from the memory to perform programmed processing operations, and to estimate the surface temperature of pressure roller 103.

To put it more specifically, the temperature setting of the heat roller 104 in the low power mode is adjusted based on the information on the estimated surface temperature of the pressure roller 103. This eliminates the need of supply of excessive power for the maintenance of the temperature of the heat roller 104. It also effectively avoid thermal offset caused by excessive heating performed at the time of heat fixing. What is more, the cost can be reduced because it is not necessary to use the pressure roller temperature detecting means.

The fixing device of the image forming apparatus described in Configuration (7) is characterized in that, in the image forming apparatus having the means for measuring the time of supplying electric power to the fixing device, the information on the rise of surface temperature of the heat roller and the time of supplying electric power is recorded in the memory of control means 1, when power is supplied to the fixing device from the power supply means at the time of startup. It is further characterized in that the CPU (central processor unit) of the control means 1 performs processing programmed processing and predicts the heat roller temperature rise rate.

The above-mentioned temperature rise rate can be expressed as follows:

$$\text{Temperature rise rate} = \Delta T/t (^\circ\ \text{C./sec})$$

Where t (sec) denotes the time of supplying electric power, which is measured by the power supply time measuring means. $\Delta T$ (° C.) indicates changes in the heat roller temperature. If the temperature rise rate is known, it is possible to calculate and set the heat roller temperature in the low power mode where the heat roller temperature to permit fixing can be attained in 30 seconds. This allows a proper amount of electric power—neither too much nor too little—to be supplied in the low power mode. In other words, this allows the fixable temperature to be reached within a predetermined period of time, without wasting excess energy.

The fixing device of the image forming apparatus described in Configuration (8) is characterized in that, based on the value calculated by the prediction of the percentage of the heat roller temperature rise described in the above-mentioned Configuration (7), the CPU (central processor unit) of the control means 1 makes an automatic adjustment of the set temperature of the heating roller in the low power mode, thereby supplying only the power required for the fixing device, and enable the apparatus in a short time.

The fixing device of the image forming apparatus described in Configuration (9) is characterized in that, in the image forming apparatus comprising a fixing device having heat roller surface temperature detecting means and surface temperature control means, when the heat roller set temperature A in the fixing mode is changed to the set temperature B, the heat roller set temperature in the low power mode is automatically adjusted to the set temperature C which has been preset to the set temperature B.

This allows a proper amount of electric power—neither too much nor too little—to be supplied to the fixing device only when in use, and enables the apparatus in a very short time. Furthermore, it allows a quick, accurate and flexible setting of the low power mode conditions in the change of a developer and in the change of the environment where the image forming apparatus is placed.

The present invention provides an image forming apparatus that saves energy and cuts down the operation costs when the image forming apparatus is started up or it is placed in the wait mode (where image forming apparatus is not used).

As described above, the present invention provides an energy-saving image forming apparatus of a very simple configuration capable of minimizing the use of electric power by detecting and predicting the pressure roller temperature.

What is claimed is:

1. A method of controlling a fixing temperature of a fixing device having a heat roller provided with a heat source, and having a pressure roller, which is in pressure contact with the heat roller, comprising the steps of:

measuring an elapsed time from a time of heating operation completion when the temperature of the heat roller reached at a temperature where fixing is capable;

varying a control temperature of the heat roller according to the elapsed time.

2. A method of controlling a fixing temperature of a fixing device having a heat roller provided with a heat source and a first temperature detector provided at the vicinity of the heat roller, and having a pressure roller, which is in pressure contact with the heat roller, provided with a second temperature sensor at the vicinity of the pressure roller, comprising the steps of:

detecting a temperature of the pressure roller by the second temperature detector;

measuring an elapsed time from a time of heating operation completion when the temperature of the heat roller reached at a temperature where fixing is capable; and varying a control temperature of the heat roller according to the detected temperature of the pressure roller and the elapsed time from a time of heating operation completion.

3. The method of controlling the fixing temperature according to claim 1, further comprising the steps of:

detecting a temperature and/or a humidity in an image forming apparatus including the fixing apparatus; and varying the control temperature of the heat roller according to the detected temperature and/or humidity in the image forming apparatus.

4. An image forming apparatus comprising:

a toner image forming section for forming a toner image on a photoreceptor;

a transfer section for transferring the toner image from the photoreceptor on to a transfer sheet; and a fixing device for fixing the toner image on the transfer sheet, the fixing device having:

a heat roller provided with a heat source and a first temperature detector at the vicinity of the heat roller;

a pressure roller, which is in pressure contact with the heat roller;

a controller for controlling the fixing temperature of the fixing device; and an elapsed time measuring device for measuring an elapsed time from a time of heating operation completion when the temperature of the heat roller reached at a temperature where fixing is capable; wherein, the controller varies a control temperature of the heat roller according to the elapsed time from the time of heating operation completion.

5. The image forming apparatus of claim 4, wherein, the pressure roller is provided with a second temperature detector at the vicinity of the pressure roller, and the controller varies a control temperature of the heat roller according to the elapsed time from the time of heating operation completion and according to a detected temperature of the pressure roller.

6. The image forming apparatus of claim 4, further comprising a detector for detecting a temperature and/or humidity in the image forming apparatus, wherein the controller varies the control temperature of the heat roller according to the elapsed time from the time of heating operation completion and according to the detected temperature and/or humidity in the image forming apparatus.

7. An image forming apparatus comprising:

a toner image forming section for forming a toner image on a photoreceptor;

a transfer section for transferring the toner image from the photoreceptor on to a transfer sheet; and a fixing device for fixing the toner image on the transfer sheet, the fixing device having:

a heat roller provided with a heat source and a first temperature detector at the vicinity of the heat roller; and a pressure roller, which is in pressure contact with the heat roller, provided a second temperature detector at the vicinity of the pressure roller;

a controller for controlling the fixing temperature of the fixing device;

wherein, a low power mode is established in a wait state of the image forming apparatus, and the controller varies a temperature setting for the heat roller in the low power mode according to the temperature of the pressure roller.

8. An image forming apparatus comprising:

a toner image forming section for forming a toner image on a photoreceptor;

a transfer section for transferring the toner image from the photoreceptor on to a transfer sheet; and a fixing device for fixing the toner image on the transfer sheet, the fixing device having:

a heat roller provided with a heat source and a first temperature detector at the vicinity of the heat roller;

a pressure roller, which is in pressure contact with the heat roller;

a controller for controlling the fixing temperature of the fixing device; and a temperature estimation device for estimating a temperature of the pressure roller based on an operation history of the fixing device; wherein, the controller controls the fixing temperature according to the estimated temperature of the pressure roller.

9. An image forming apparatus comprising:

a toner image forming section for forming a toner image on a photoreceptor;

a transfer section for transferring the toner image from the photoreceptor on to a transfer sheet; and a fixing device for fixing the toner image on the transfer sheet, the fixing device having:

a heat roller provided with a heat source and a first temperature detector at the vicinity of the heat roller; and a pressure roller, which is in pressure contact with the heat roller;

a power supply device for supplying power to the fixing device;

a time measuring device for measuring a time period of supplying power to the fixing device;

a temperature estimation device for estimating a temperature rise rate of the heat roller, when the power supply device have supplied a power to the fixing device during a warm-up mode, based on the heat roller temperature and the time period of supplying power; and a controller for controlling the fixing temperature of the fixing device;

wherein, the controller controls the fixing temperature according to the estimated temperature rise rate of the heat roller.

10. The image forming apparatus of claim 9, wherein a low power mode is established in a wait state of the image forming apparatus, and according to a temperature rise rate calculated by the temperature estimation device, the controller adjusts a setting temperature of the heat roller in the low power mode.

11. An image forming apparatus comprising:

a toner image forming section for forming a toner image on a photoreceptor;

a transfer section for transferring the tone image from the photoreceptor on to a transfer sheet; and a fixing device for fixing the toner image on the transfer sheet, the fixing device having:

a heat roller provided with a heat source and a first temperature detector at the vicinity of the heat roller; and a pressure roller, which is in pressure contact with the heat roller;

a controller for controlling the fixing temperature of the fixing device;

wherein, when a setting temperature of the heat roller in a fixing mode is changed from A to B, a setting temperature of the heat roller in a low power mode is adjusted to C, which is previously set corresponding to the setting temperature B in the fixing mode.

* * * * *